US010152886B2

(12) United States Patent
Weber

(10) Patent No.: US 10,152,886 B2
(45) **Date of Patent: *Dec. 11, 2018**

(54) DRIVER ASSISTANCE SYSTEM WITH TRAFFIC LIGHT ALERT

(71) Applicant: MAGNA ELECTRONICS INC., Auburn Hills, MI (US)

(72) Inventor: Christian Weber, Karlsbad (DE)

(73) Assignee: MAGNA ELECTRONICS INC., Auburn Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/878,714

(22) Filed: Jan. 24, 2018

(65) Prior Publication Data

US 2018/0165957 A1 Jun. 14, 2018

Related U.S. Application Data

(63) Continuation of application No. 15/341,045, filed on Nov. 2, 2016, now Pat. No. 9,881,501.

(60) Provisional application No. 62/249,468, filed on Nov. 2, 2015.

(51) Int. Cl.

| | |
|---|---|
| ***G08G 1/09*** | (2006.01) |
| ***G08G 1/0967*** | (2006.01) |
| ***G08G 1/0962*** | (2006.01) |

(52) U.S. Cl.

CPC ... *G08G 1/096783* (2013.01); *G08G 1/09623* (2013.01); *G08G 1/096716* (2013.01); *G08G 1/096758* (2013.01)

(58) Field of Classification Search

CPC ..... G08G 1/096783; G08G 1/096716; G08G 1/09623; G08G 1/096758; G08G 1/0967; G08G 1/0962; G08G 1/095; G08G 1/0955

USPC ..... 340/905, 907, 915, 917, 901; 701/70, 701/117

See application file for complete search history.

(56) References Cited

U.S. PATENT DOCUMENTS

| | | | |
|---|---|---|---|
| 5,550,677 | A | 8/1996 | Schofield et al. |
| 5,635,920 | A | 6/1997 | Pogue |
| 5,670,935 | A | 9/1997 | Schofield et al. |
| 5,949,331 | A | 9/1999 | Schofield et al. |

(Continued)

FOREIGN PATENT DOCUMENTS

| | | |
|---|---|---|
| DE | 102014003781 | 9/2015 |

*Primary Examiner* — Anh V La

(74) *Attorney, Agent, or Firm* — Honigman Miller Schwartz and Cohn LLP

(57) ABSTRACT

A traffic light alert system for a vehicle includes a camera, a processor that processes image data captured by the camera to determine a signal status of a traffic light present ahead of the vehicle, and a global positioning system operable to determine a current geographical location of the vehicle. A display device is operable to display an iconistic traffic light representation. Responsive to determination, via processing of image data captured by the camera, that the traffic light ahead of and being approached by the vehicle has a particular signal status, a control controls the display device so that the displayed iconistic traffic light representation indicates the determined particular signal status. The control adjusts orientation of the displayed iconistic traffic light representation between horizontal orientation and vertical orientation responsive to the current geographic location of the vehicle as determined by the global positioning system of the vehicle.

20 Claims, 8 Drawing Sheets

(56) References Cited

U.S. PATENT DOCUMENTS

| | | | |
|---|---|---|---|
| 6,087,953 | A | 7/2000 | DeLine et al. |
| 6,172,613 | B1 | 1/2001 | DeLine et al. |
| 6,243,003 | B1 | 6/2001 | DeLine et al. |
| 6,250,148 | B1 | 6/2001 | Lynam |
| 6,278,377 | B1 | 8/2001 | DeLine et al. |
| 6,326,613 | B1 | 12/2001 | Heslin et al. |
| 6,420,975 | B1 | 7/2002 | DeLine et al. |
| 6,428,172 | B1 | 8/2002 | Hutzel et al. |
| 6,445,287 | B1 | 9/2002 | Schofield et al. |
| 6,690,268 | B2 | 2/2004 | Schofield et al. |
| 6,693,517 | B2 | 2/2004 | McCarthy et al. |
| 6,824,281 | B2 | 11/2004 | Schofield et al. |
| 7,004,593 | B2 | 2/2006 | Weller et al. |
| 7,289,037 | B2 | 10/2007 | Uken et al. |
| 7,480,149 | B2 | 1/2009 | DeWard et al. |
| 7,580,795 | B2 | 8/2009 | McCarthy et al. |
| 8,256,821 | B2 | 9/2012 | Lawlor et al. |
| 9,041,806 | B2 | 5/2015 | Baur et al. |
| 9,264,672 | B2 | 2/2016 | Lynam |
| 9,596,387 | B2 | 3/2017 | Achenbach et al. |
| 9,881,501 | B2 | 1/2018 | Weber |
| 2009/0295181 | A1 | 12/2009 | Lawlor et al. |
| 2011/0093178 | A1 | 4/2011 | Yamada |
| 2012/0062743 | A1 | 3/2012 | Lynam et al. |
| 2012/0218412 | A1 | 8/2012 | Dellantoni et al. |
| 2013/0002451 | A1 | 1/2013 | Chen |
| 2013/0063281 | A1 | 3/2013 | Malaska |
| 2013/0222592 | A1 | 8/2013 | Gieseke |
| 2013/0253754 | A1* | 9/2013 | Ferguson ..... G05D 1/0231 701/28 |
| 2014/0111646 | A1* | 4/2014 | Hamilton, Sr. ..... B60R 1/00 348/148 |
| 2014/0218529 | A1 | 8/2014 | Mahmoud |
| 2014/0226012 | A1 | 8/2014 | Achenbach |
| 2014/0375476 | A1 | 12/2014 | Johnson et al. |
| 2015/0015713 | A1 | 1/2015 | Wang et al. |
| 2015/0124096 | A1 | 5/2015 | Koravadi |
| 2015/0158499 | A1 | 6/2015 | Koravadi |
| 2015/0251599 | A1 | 9/2015 | Koravadi |
| 2015/0262483 | A1 | 9/2015 | Sugawara |
| 2015/0327398 | A1 | 11/2015 | Achenbach et al. |
| 2015/0352953 | A1 | 12/2015 | Koravadi |
| 2015/0379872 | A1 | 12/2015 | Al-Qaneei |
| 2016/0036917 | A1 | 2/2016 | Koravadi et al. |
| 2016/0148508 | A1 | 5/2016 | Morimoto |
| 2016/0210853 | A1 | 7/2016 | Koravadi |
| 2017/0124868 | A1 | 5/2017 | Bhat |

* cited by examiner

PRIOR ART

PRIOR ART

DRIVER ASSISTANCE SYSTEM WITH TRAFFIC LIGHT ALERT

CROSS REFERENCE TO RELATED APPLICATIONS

The present application is a continuation of U.S. patent application Ser. No. 15/341,045, filed Nov. 2, 2016, now U.S. Pat. No. 9,881,501, which claims the filing benefits of U.S. provisional application Ser. No. 62/249,468 filed Nov. 2, 2015, which is hereby incorporated herein by reference in its entirety.

FIELD OF THE INVENTION

The present invention relates generally to a vehicle vision system for a vehicle and, more particularly, to a vehicle vision system that utilizes one or more cameras at a vehicle.

BACKGROUND OF THE INVENTION

Use of imaging sensors in vehicle imaging systems is common and known. Examples of such known systems are described in U.S. Pat. Nos. 5,949,331; 5,670,935 and/or 5,550,677, which are hereby incorporated herein by reference in their entireties. Image processing of captured image data may be used to detect objects, such as traffic lights, forward of the vehicle and in the field of view of one or more of the imaging sensors.

Known vehicle traffic light indication or monitoring systems may display a traffic light's augmented image in the shape of a traffic light head having the typical three lights (red, yellow and green) on a head unit display or head up system or a cluster display. An example of such a display is shown in FIGS. 2 and 3. These display augmentations are similar to those described in German patent application DE102014003781.

SUMMARY OF THE INVENTION

The present invention provides a driver assistance system or traffic light alert system for a vehicle that utilizes one or more cameras (preferably one or more CMOS cameras) to capture image data representative of images exterior of the vehicle, and provides an enhanced display of a traffic light alert to provide enhanced cognitive awareness by the driver of the status of a traffic light ahead of the vehicle. The traffic light alert system displays an iconistic representation of a traffic signal and a background region surrounding or at least partially around the displayed iconistic representation. The display, responsive to a determination of a status of a traffic light ahead of the vehicle, adjusts the display to highlight or illuminate an appropriate one of the lights (upper, middle, lower) of the iconistic traffic light representation and to display the background in the appropriate color. For example, if the system determines that the detected traffic light's upper red light is activated, the upper light of the iconistic traffic light representation is illuminated and the background is displayed as red.

These and other objects, advantages, purposes and features of the present invention will become apparent upon review of the following specification in conjunction with the drawings.

DESCRIPTION OF THE PREFERRED EMBODIMENTS

A vehicle traffic light alert system and/or driver assist system and/or object detection system and/or alert system operates to capture images exterior of the vehicle and may process the captured image data to display images and to detect objects at or near the vehicle and in the predicted path of the vehicle, such as to assist a driver of the vehicle in maneuvering the vehicle in a rearward direction. The traffic light alert system includes an image processor or image processing system that is operable to receive image data from one or more cameras and provide an output to a display device for displaying images representative of the captured image data. The traffic light alert system provides a display that represents the traffic light. The system may provide a rearview display or a top down or bird's eye or surround view display or the like.

Figure 1:
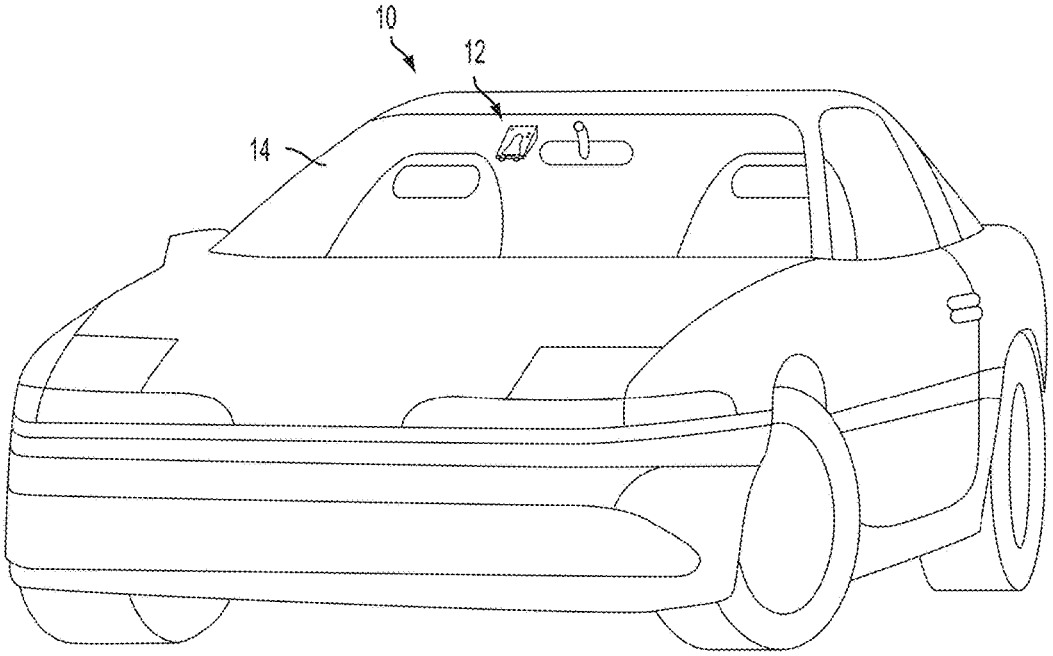
FIG. 1 is a perspective view of a vehicle with a driver assistance system that incorporates a forward viewing camera in accordance with the present invention.
Figure 2:
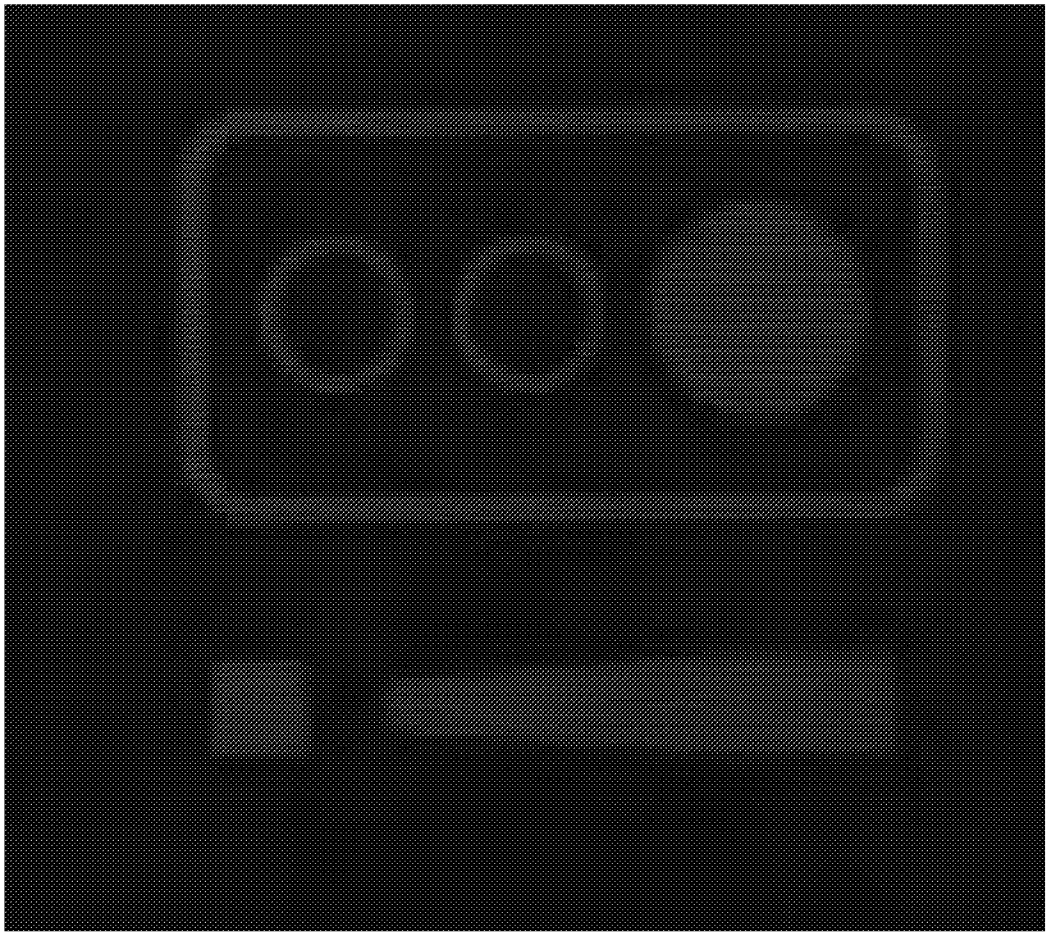
FIG. 2 shows a prior art display showing a traffic signal alert.
Figure 3:
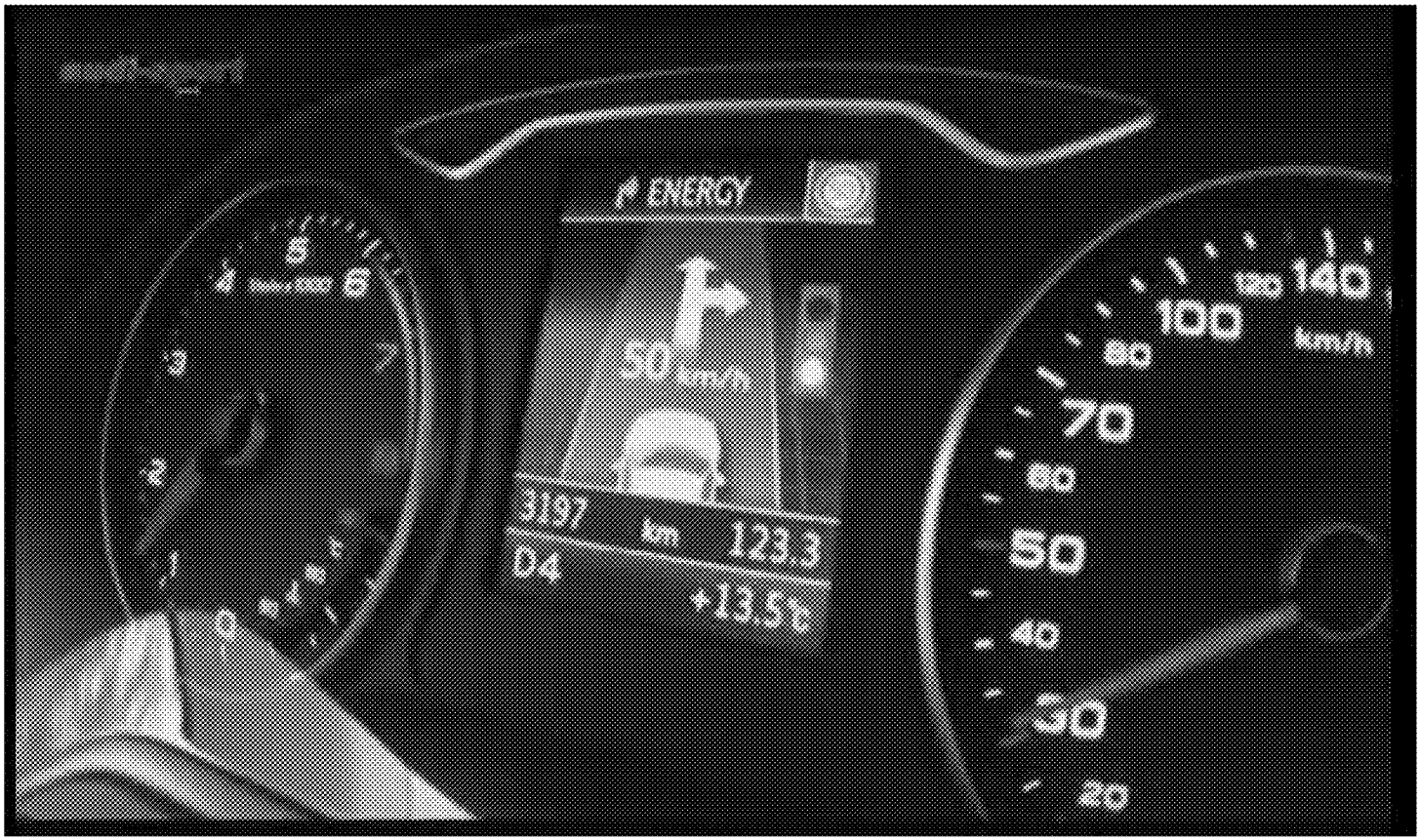
FIG. 3 shows another prior art traffic signal alert display.
Figure 4:
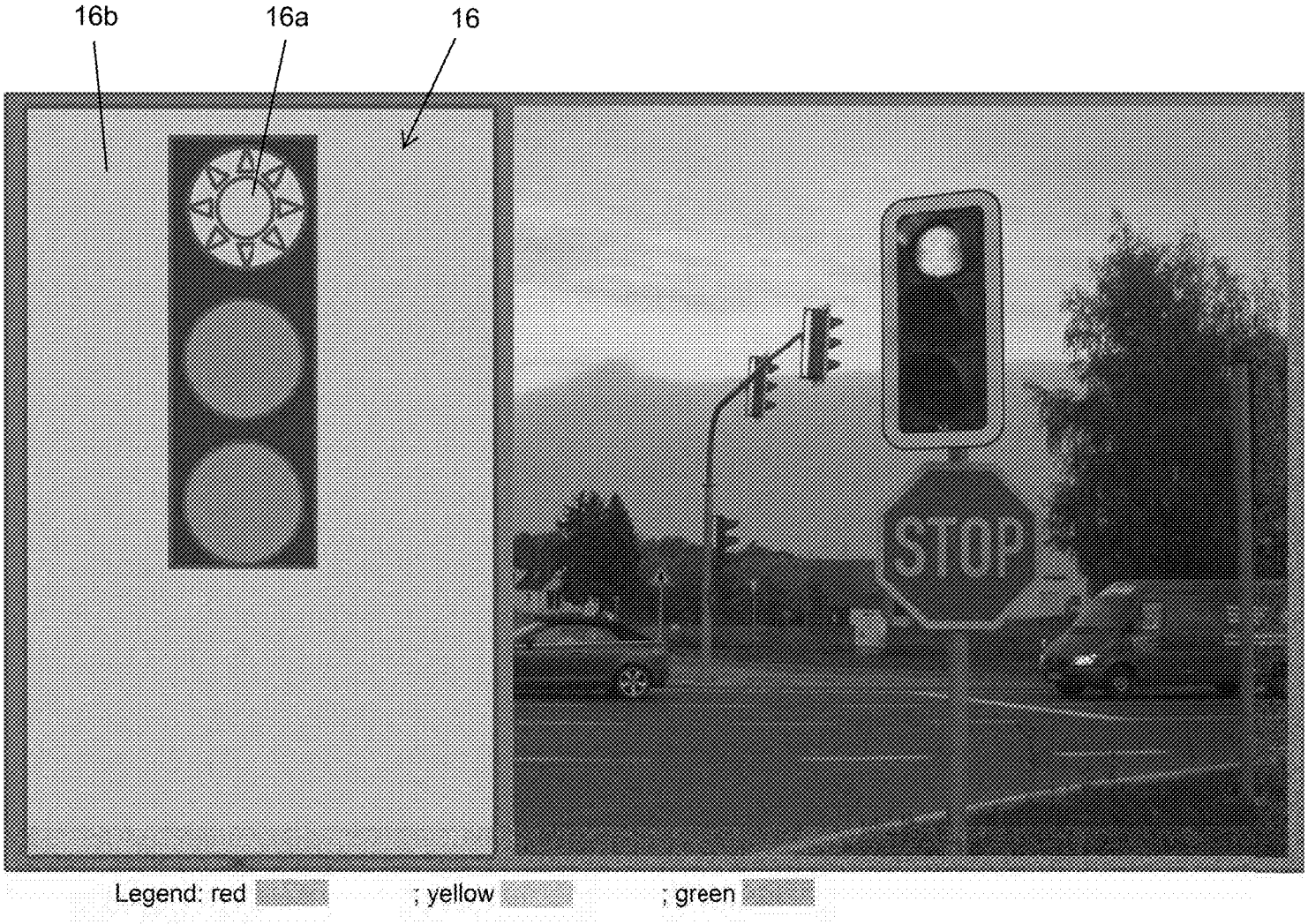
FIG. 4 shows an alert display (at the left side of FIG. 4) showing a red traffic light signal icon and a red background in accordance with the present invention, with the right side of FIG. 4 showing the traffic light status represented by the displayed icon.
Figure 5:
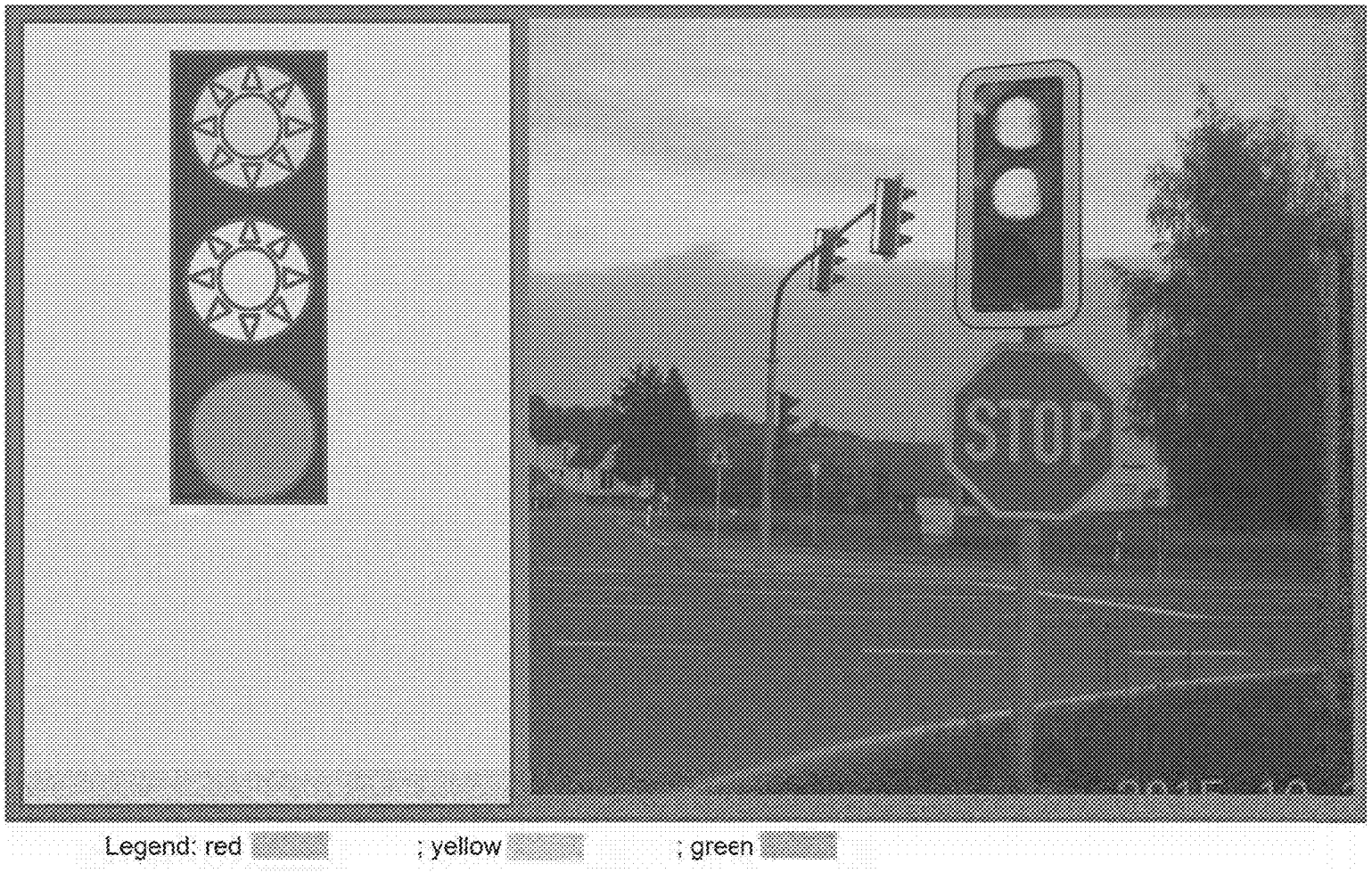
FIG. 5 shows the alert display showing a red-yellow traffic light signal icon and a yellow background in accordance with the present invention.
Figure 6:
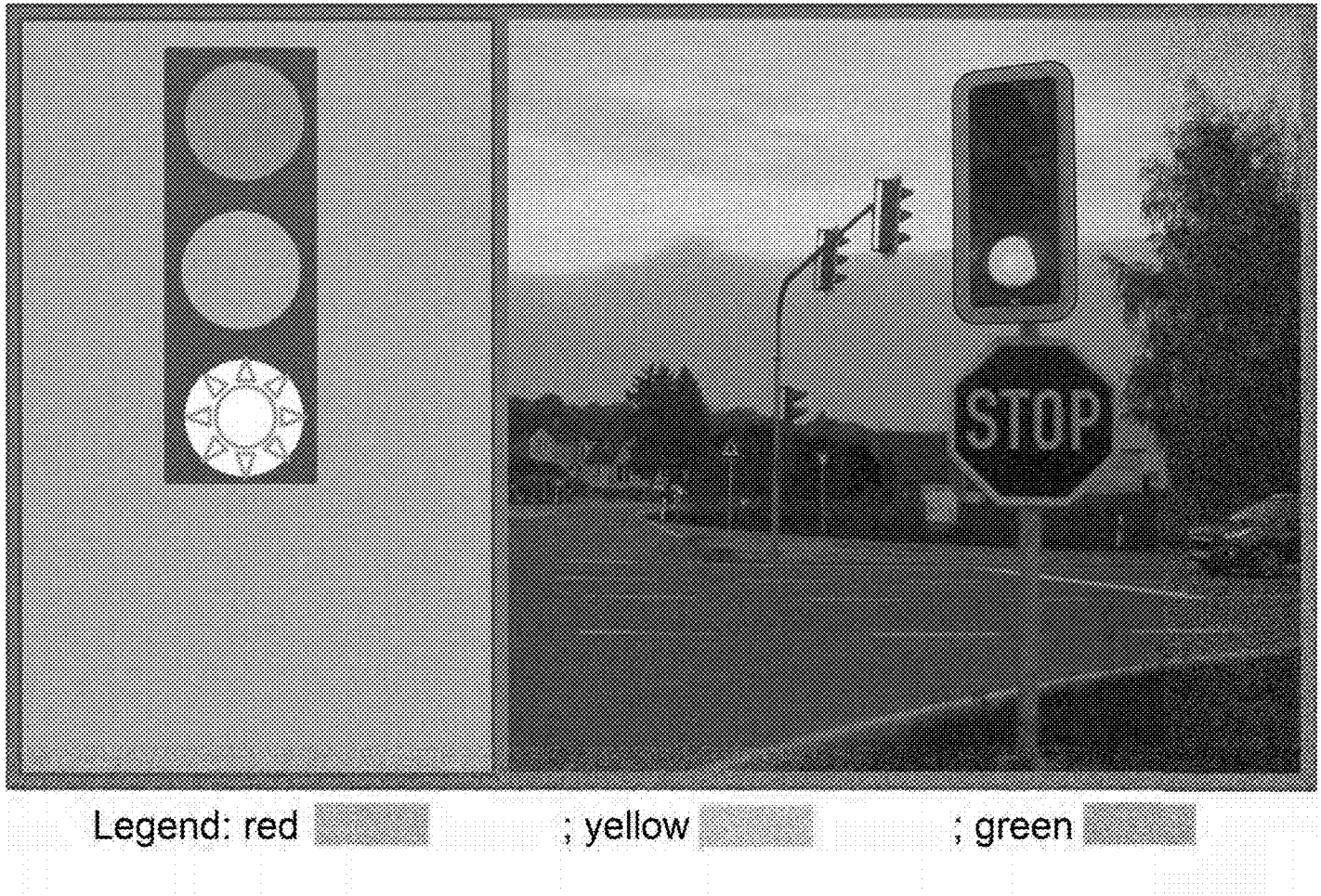
FIG. 6 shows the alert display showing a green traffic light signal icon and a green background in accordance with the present invention.
Figure 7:
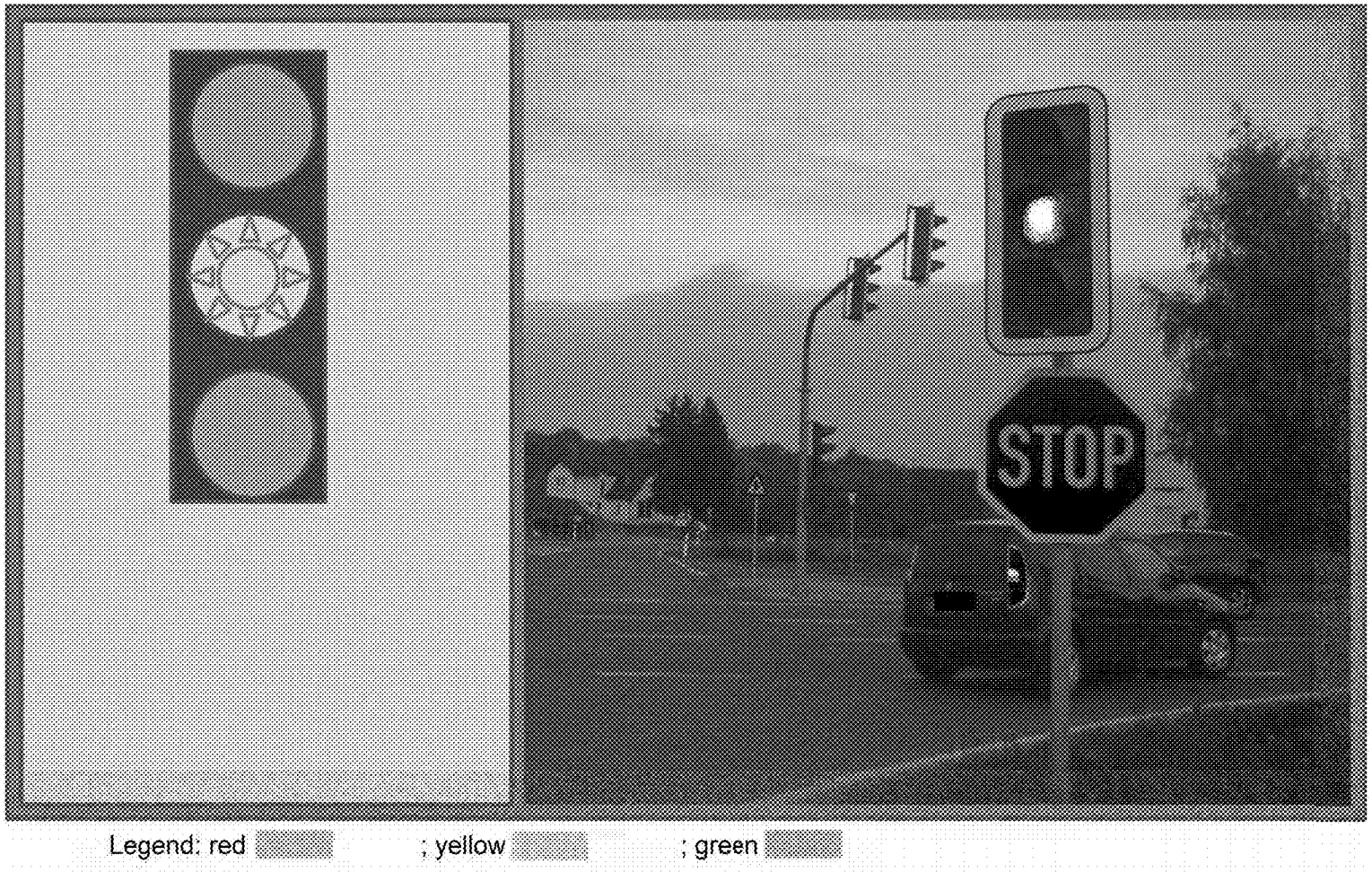
FIG. 7 shows the alert display showing a yellow traffic light signal icon and a yellow background in accordance with the present invention.

Referring now to the drawings and the illustrative embodiments depicted therein, a vehicle 10 includes a traffic light alert system that includes a forward viewing camera module 12 that is disposed at and views through the windshield 14 of the vehicle and captures image data of the scene exterior and forward of the vehicle (FIG. 1). The camera module includes a lens for focusing images at or onto an imaging array or imaging plane or imager of the camera. The forward viewing camera views through the windshield and forward of the vehicle, such as for a machine vision system (such as for traffic sign recognition, headlamp control, pedestrian detection, collision avoidance, lane marker detection and/or the like). The system includes a control or electronic control unit (ECU) or processor that is operable to process image data captured by the camera or cameras and may detect objects or the like and/or provide displayed images at a display device for viewing by the driver of the vehicle. The display device may comprise a cluster display, a head unit display, head up display or eye glass display or the like. The data transfer or signal communication from the camera to the ECU may comprise any suitable data or communication link, such as a vehicle network bus or the like of the equipped vehicle.

The camera system or camera module of the present invention may utilize aspects of the systems and/or modules described in International Publication Nos. WO 2013/123161 and/or WO 2013/019795, and/or U.S. Pat. Nos.

8,256,821; 7,480,149; 7,289,037; 7,004,593; 6,824,281; 6,690,268; 6,445,287; 6,428,172; 6,420,975; 6,326,613; 6,278,377; 6,243,003; 6,250,148; 6,172,613 and/or 6,087,953, and/or U.S. Publication Nos. US-2015-0327398; US-2014-0226012 and/or US-2009-0295181, which are all hereby incorporated herein by reference in their entireties. Optionally, the system may include a plurality of exterior facing imaging sensors or cameras, such as a rearward facing imaging sensor or camera, a forwardly facing camera at the front of the vehicle, and sidewardly/rearwardly facing cameras at respective sides of the vehicle, which capture image data representative of the scene exterior of the vehicle.

The control includes an image processor that processes captured images to detect and identify objects forward of the vehicle and in the field of view of the camera. Responsive to such image processing, the control may determine and identify traffic signals and may determine the signal status, such as which of the typically three lights (red, yellow, green), or sometimes just two lights (red, green) or sometimes just one light (just red), is activated as the vehicle approaches the detected traffic light. Responsive to such determinations, the system is operable to display an iconistic representation of a traffic light, with the appropriate light highlighted depending on which light of the traffic light is activated.

Figure 8:
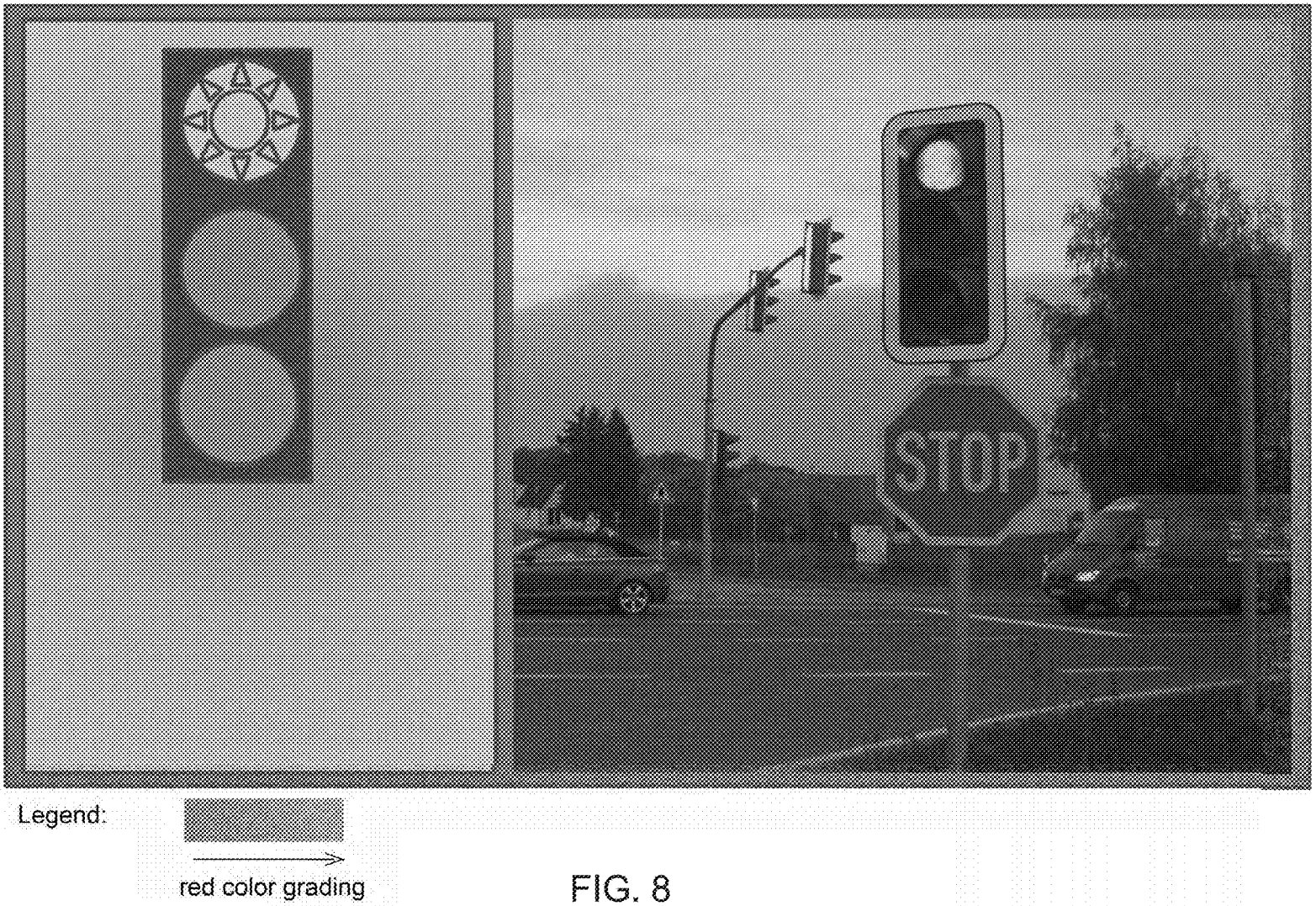
FIG. 8 shows an alert display showing a red traffic light signal icon and a red background, which has a color grading towards the display area's borderlines, in accordance with the present invention.

To improve the driver's conception of the visual traffic light display, the present invention provides an enhanced display 16 that more clearly indicates the status of the traffic light to the driver of the vehicle. For example, and such as can be seen with reference to FIGS. 4-7, the display 16 displays an iconistic representation of the traffic sign's light or lights 16*a* to show the traffic light's determined signal or status but also adjusts or augments the background 16*b* (the area around the iconistic representation of the traffic light) within the display, with the background augmentation corresponding with the traffic signal's activated light color. FIGS. 4-8 show the iconistic representations and backgrounds at the left side and show an image of the traffic signal determined to be present ahead of the vehicle at the right side. For example, with reference to FIG. 4, when the system determines that a traffic signal has its red light activated, the display 16 has the upper light icon shown as activated, with the background 16*b* colored red to further enhance the driver's recognition that the traffic signal is red. Similarly, when the system determines that a traffic signal has both the red and yellow lights activated (see FIG. 5), the display has the upper two light icons shown as activated, with the background colored yellow (or optionally red). Also, when the system determines that a traffic signal has the green light activated (see FIG. 6), the display has the lower light icon shown as activated, with the background colored green, and when the system determines that a traffic signal has the yellow light activated (see FIG. 7), the display has the middle light icon shown as activated, with the background colored yellow. Optionally, the background color may be augmented as semi-transparent or in a color grading towards the display area's borderlines such as shown in FIG. 8 (where the background is red near a center region of the display, but fades or grades towards a different color towards the border of the display.

The system may adjust the display and/or iconistic traffic light representation depending on various driving conditions or situations encountered by the vehicle. For example, depending on the region where the vehicle is driven, the iconistic traffic light representation may comprise three icons lights vertically oriented (as shown in FIGS. 4-8), or the iconistic traffic light representation may comprise three horizontally oriented icon lights or may comprise only two lights or the like. The display is operable to illuminate or highlight a selected one of the lights. The iconistic traffic light representation may comprise an electronically generated overlay (or optionally a physical etched or masked icon) that is displayed at the screen and backlit to provide the desired light representation (for example, a red, yellow or green light of the iconistic traffic light representation). Optionally, the iconistic traffic light representation may be displayed via a reconfigurable display screen (such as a backlit thin film transistor (TFT) display screen or the like) that is operable to display the iconistic traffic light representation. Optionally, the display may display a selected type of iconistic traffic light representation, with the style or design or orientation of the iconistic traffic light representation being selected responsive to image processing of image data captured by a camera with the traffic light that is being approached being in its field of view (or optionally responsive to a GPS system of the vehicle whereby the system knows the geographical location of the vehicle and may display an iconistic traffic light representation that represents a traffic light that is typical for that area).

The system may detect and identify the traffic light via image processing (via the processing system or processor) of image data captured by a forward facing camera of the vehicle. Optionally, the status of the traffic light may be communicated to the vehicle control via a car-to-infrastructure or car2x communication system, where a wireless communication indicative of the traffic light status is received by a receiver of the vehicle and used to adjust the display accordingly.

The system thus may communicate with other systems, such as via a vehicle-to-vehicle communication system or a vehicle-to-infrastructure communication system or the like. Such car2car or vehicle to vehicle (V2V) and vehicle-to-infrastructure (car2X or V2X or V2I or 4G or 5G) technology provides for communication between vehicles and/or infrastructure based on information provided by one or more vehicles and/or information provided by a remote server or the like. Such vehicle communication systems may utilize aspects of the systems described in U.S. Pat. Nos. 6,690,268; 6,693,517 and/or 7,580,795, and/or U.S. Publication Nos. US-2014-0375476; US-2014-0218529; US-2013-0222592; US-2012-0218412; US-2012-0062743; US-2015-0251599; US-2015-0158499; US-2015-0124096; US-2015-0352953; US-2016-0036917 and/or US-2016-0210853, which are hereby incorporated herein by reference in their entireties.

In U.S. provisional application Ser. No. 62/266,734, filed Dec. 14, 2015, which is hereby incorporated herein by reference in its entirety, optical data transmission between a street light and a vehicle (V2X) using a timely modulated code, a code pattern modulated code or a combination of timely and pattern modulated codes, optionally using visual and/or infrared wavelengths or spectral bands, was suggested for providing monodirectional or bidirectional optical data transmission. In U.S. provisional application Ser. No. 62/330,558, filed May 2, 2016, which is hereby incorporated herein by reference in its entirety, vehicle positioning by visible light communication was described.

Optionally, the vehicle system and the traffic light may be equipped with visible light communication (VLC) by machine vision means, such as by utilizing aspects of the systems and/or modules described in the above incorporated U.S. provisional applications, Ser. No. 62/330,558 and/or Ser. No. 62/266,734, and having LEDs as traffic lights for encoding data into the light stream, and processing means such as having a processor and optionally transceivers for encoding the traffic light's status (green, red, red-blinking, red-yellow or yellow, or yellow-blinking) and for encoding the according lane (assuming a map is known with each traffic light's lane number), area or GPS position that the according traffic light signal is for or corresponds with. Optionally, a time or countdown until the light status changes to another defined light status may be transmitted or communicated as well. For example, in case the vehicle light receiving device is a 30 Hz forward vision RGB camera and the traffic light is done primitively, just encoding one bit by being on or off at a time (using a simple single bit coding scheme like Miller, Manchester, DBP or NRZ), the light data channel may transmit up to 15 bits per second. When the encoding is done in a data compressed manner (such as using a lossless compression such a kind of Lempel-Ziv (LZ), which are based on finite state machines or such kinds using prediction by partial matching methods) and/or the traffic light is encoding more than one bit at a time such as by using phase shift coding (phase modulation) and/or amplitude coding (amplitude modulation) and/or frequency (color) coding (frequency modulation) or combinations of all, such as quadrature amplitude modulation, more data may be transmitted at a time. The data may be sent repeatedly without a handshake. The vehicle system may synchronize to the VLC data stream and continue to read it until the traffic light is out of sight of the receiving device. In case the line of sight is interrupted, the vehicle system may interpolate (by any logic or by using parity bits) or correct missing data as far as possible. For example, the vehicle system may continue the countdown until a traffic light changes from green to yellow by using its inherent clock, also when the traffic light's VLC is interrupted for any reason.

The camera or sensor may comprise any suitable camera or sensor. Optionally, the camera may comprise a "smart camera" that includes the imaging sensor array and associated circuitry and image processing circuitry and electrical connectors and the like as part of a camera module, such as by utilizing aspects of the vision systems described in International Publication Nos. WO 2013/081984 and/or WO 2013/081985, which are hereby incorporated herein by reference in their entireties.

The system includes an image processor operable to process image data captured by the camera or cameras, such as for detecting objects or other vehicles or pedestrians or the like in the field of view of one or more of the cameras. For example, the image processor may comprise an image processing chip selected from the EyeQ family of image processing chips available from Mobileye Vision Technologies Ltd. of Jerusalem, Israel, and may include object detection software (such as the types described in U.S. Pat. Nos. 7,855,755; 7,720,580 and/or 7,038,577, which are hereby incorporated herein by reference in their entireties), and may analyze image data to detect vehicles and/or other objects. Responsive to such image processing, and when an object or other vehicle is detected, the system may generate an alert to the driver of the vehicle and/or may generate an overlay at the displayed image to highlight or enhance display of the detected object or vehicle, in order to enhance the driver's awareness of the detected object or vehicle or hazardous condition during a driving maneuver of the equipped vehicle.

The vehicle may include any type of sensor or sensors, such as imaging sensors or radar sensors or lidar sensors or ladar sensors or ultrasonic sensors or the like. The imaging sensor or camera may capture image data for image processing and may comprise any suitable camera or sensing device, such as, for example, a two dimensional array of a plurality of photosensor elements arranged in at least 640 columns and 480 rows (at least a 640×480 imaging array, such as a megapixel imaging array or the like), with a respective lens focusing images onto respective portions of the array. The photosensor array may comprise a plurality of photosensor elements arranged in a photosensor array having rows and columns. Preferably, the imaging array has at least 300,000 photosensor elements or pixels, more preferably at least 500,000 photosensor elements or pixels and more preferably at least 1 million photosensor elements or pixels. The imaging array may capture color image data, such as via spectral filtering at the array, such as via an RGB (red, green and blue) filter or via a red/red complement filter or such as via an RCC (red, clear, clear) filter or the like. The logic and control circuit of the imaging sensor may function in any known manner, and the image processing and algorithmic processing may comprise any suitable means for processing the images and/or image data.

For example, the vision system and/or processing and/or camera and/or circuitry may utilize aspects described in U.S. Pat. Nos. 8,694,224; 7,005,974; 5,760,962; 5,877,897; 5,796,094; 5,949,331; 6,302,545; 6,396,397; 6,498,620; 6,523,964; 6,611,202; 6,201,642; 6,690,268; 6,717,610; 6,757,109; 6,802,617; 6,806,452; 6,822,563; 6,891,563; 6,946,978; 7,859,565; 5,550,677; 5,670,935; 7,881,496; 7,720,580; 7,038,577; 6,882,287; 5,929,786 and/or 5,786,772, which are all hereby incorporated herein by reference in their entireties. The system may communicate with other communication systems via any suitable means, such as by utilizing aspects of the systems described in International Publication Nos. WO/2010/144900; WO 2013/043661 and/or WO 2013/081985, and/or U.S. Publication No. US-2012-0062743, which are hereby incorporated herein by reference in their entireties.

The imaging device and control and image processor and any associated illumination source, if applicable, may comprise any suitable components, and may utilize aspects of the cameras (such as various imaging sensors or imaging array sensors or cameras or the like, such as a CMOS imaging array sensor, a CCD sensor or other sensors or the like) and vision systems described in U.S. Pat. Nos. 5,760,962; 5,715,093; 6,922,292; 6,757,109; 6,717,610; 6,590,719; 6,201,642; 5,796,094; 6,559,435; 6,831,261; 6,822,563; 6,946,978; 7,720,580; 8,542,451; 7,965,336; 7,480,149; 5,550,677; 5,877,897; 6,498,620; 5,670,935; 5,796,094; 6,396,397; 6,806,452; 6,690,268; 7,005,974; 7,937,667; 7,123,168; 7,004,606; 6,946,978; 7,038,577; 6,353,392; 6,320,176; 6,313,454 and/or 6,824,281, and/or International Publication Nos. WO 2009/036176; WO 2009/046268; WO 2010/099416; WO 2011/028686 and/or WO 2013/016409, and/or U.S. Pat. Publication Nos. US 2010-0020170 and/or US-2009-0244361, which are all hereby incorporated herein by reference in their entireties.

Optionally, the vision system may include a display for displaying images captured by one or more of the imaging sensors for viewing by the driver of the vehicle while the driver is normally operating the vehicle. Optionally, for example, the vision system may include a video display device, such as by utilizing aspects of the video display systems described in U.S. Pat. Nos. 5,530,240; 6,329,925; 7,855,755; 7,626,749; 7,581,859; 7,446,650; 7,338,177; 7,274,501; 7,255,451; 7,195,381; 7,184,190; 5,668,663; 5,724,187; 6,690,268; 7,370,983; 7,329,013; 7,308,341; 7,289,037; 7,249,860; 7,004,593; 4,546,551; 5,699,044; 4,953,305; 5,576,687; 5,632,092; 5,677,851; 5,708,410; 5,737,226; 5,802,727; 5,878,370; 6,087,953; 6,173,508;

6,222,460; 6,513,252 and/or 6,642,851, and/or U.S. Publication Nos. US-2012-0162427; US-2006-0050018 and/or US-2006-0061008, which are all hereby incorporated herein by reference in their entireties.

Optionally, the vision system (utilizing the forward facing camera and a rearward facing camera and other cameras disposed at the vehicle with exterior fields of view) may be part of or may provide a display of a top-down view or bird's-eye view system of the vehicle or a surround view at the vehicle, such as by utilizing aspects of the vision systems described in International Publication Nos. WO 2010/099416; WO 2011/028686; WO 2012/075250; WO 2013/019795; WO 2012/075250; WO 2012/145822; WO 2013/081985; WO 2013/086249 and/or WO 2013/109869, and/or U.S. Publication No. US-2012-0162427, which are hereby incorporated herein by reference in their entireties.

Changes and modifications in the specifically described embodiments can be carried out without departing from the principles of the invention, which is intended to be limited only by the scope of the appended claims, as interpreted according to the principles of patent law including the doctrine of equivalents.

The invention claimed is:

1. A traffic light alert system for a vehicle, said traffic light alert system comprising:

a camera disposed at a vehicle equipped with said traffic light alert system, wherein said camera views at least forward of the equipped vehicle and captures image data;

a processor that processes image data captured by said camera to determine a signal status of a traffic light present ahead of the equipped vehicle and in the field of view of said camera;

a global positioning system of the equipped vehicle that is operable to determine a current geographical location of the equipped vehicle;

a display device of the equipped vehicle, wherein said display device is operable to display an iconistic traffic light representation;

a control of the equipped vehicle;

wherein said control controls said display device responsive to determination, via processing of image data captured by said camera, of the signal status of the traffic light present ahead of the equipped vehicle and being approached by the equipped vehicle;

wherein, responsive to determination, via processing of image data captured by said camera, that the traffic light ahead of and being approached by the equipped vehicle has a particular signal status, said control controls said display device so that the displayed iconistic traffic light representation indicates the determined particular signal status;

wherein said control is operable to adjust orientation of the displayed iconistic traffic light representation between horizontal orientation and vertical orientation; and wherein said control adjusts orientation of the displayed iconistic traffic light representation between horizontal orientation and vertical orientation responsive to the current geographic location of the equipped vehicle as determined by the global positioning system of the equipped vehicle.

2. The traffic light alert system of claim 1, wherein said display device displays the iconistic traffic light representation with a background surrounding the displayed iconistic traffic light representation.

3. The traffic light alert system of claim 2, wherein, responsive to determination, via processing of image data captured by said camera, that the particular signal status of the traffic light present ahead of the equipped vehicle is an activated red light, said control controls said display device so that an iconistic red light of the displayed iconistic traffic light representation is illuminated and the surrounding background is displayed in red.

4. The traffic light alert system of claim 2, wherein, responsive to determination, via processing of image data captured by said camera, that the particular signal status of the traffic light present ahead of the equipped vehicle is an activated yellow light, said control controls said display device so that an iconistic yellow light of the displayed iconistic traffic light representation is illuminated and the surrounding background is displayed in yellow.

5. The traffic light alert system of claim 2, wherein, responsive to determination, via processing of image data captured by said camera, that the particular signal status of the traffic light present ahead of the equipped vehicle is an activated green light, said control controls said display device so that an iconistic green light of the displayed iconistic traffic light representation is illuminated and the surrounding background is displayed in green.

6. The traffic light alert system of claim 2, wherein, responsive to determination, via processing of image data captured by said camera, that the particular signal status of the traffic light present ahead of the equipped vehicle is an activated red light, said control controls said display device so that an iconistic red light of the displayed iconistic traffic light representation is illuminated and the surrounding background is displayed in red near the center of the surrounding background and surrounding the iconistic traffic light representation and is a different color towards an outer boundary of the surrounding background.

7. The traffic light alert system of claim 1, wherein determination of presence of the traffic light ahead of the equipped vehicle is made responsive to a communication system.

8. The traffic light alert system of claim 1, wherein determination of presence of the traffic light ahead of the equipped vehicle is made via vehicle-to-infrastructure communication.

9. The traffic light alert system of claim 1, wherein determination of presence of the traffic light ahead of the equipped vehicle is made via visible light communication.

10. The traffic light alert system of claim 1, wherein said traffic light alert system receives data encoded into light emitted by the traffic light.

11. The traffic light alert system of claim 10, wherein said processor of said traffic light alert system processes received encoded data to determine at least one of (i) a lane associated with the traffic light, (ii) a signal status of the traffic light and (iii) a time until the traffic light signal status changes.

12. The traffic light alert system of claim 10, wherein said control controls said display device responsive to processing of received encoded data.

13. The traffic light alert system of claim 1, wherein said camera is disposed at an in-cabin side of a windshield of the equipped vehicle and views through the windshield.

14. A traffic light alert system for a vehicle, said traffic light alert system comprising:

a camera disposed at a vehicle equipped with said traffic light alert system, wherein said camera views at least forward of the equipped vehicle and captures image data;

wherein said camera is disposed at an in-cabin side of a windshield of the equipped vehicle and views through the windshield;

wherein determination of presence of a traffic light ahead of the equipped vehicle is made responsive to a communication system;

a processor that processes image data captured by said camera to determine a signal status of the traffic light present ahead of the equipped vehicle and in the field of view of said camera;

a global positioning system of the equipped vehicle that is operable to determine a current geographical location of the equipped vehicle;

a display device of the equipped vehicle, wherein said display device is operable to display an iconistic traffic light representation;

a control of the equipped vehicle;

wherein, responsive to determination, via the communication system, of the traffic light ahead of the equipped vehicle and determination, via processing of image data captured by said camera, that the determined traffic light ahead of and being approached by the equipped vehicle has a particular signal status, said control controls said display device so that the displayed iconistic traffic light representation indicates the determined particular signal status;

wherein said control is operable to adjust orientation of the displayed iconistic traffic light representation between horizontal orientation and vertical orientation; and wherein said control adjusts orientation of the displayed iconistic traffic light representation between horizontal orientation and vertical orientation responsive to the current geographic location of the equipped vehicle as determined by the global positioning system of the equipped vehicle.

15. The traffic light alert system of claim 14, wherein the determination of the presence of the traffic light ahead of the equipped vehicle is made via vehicle-to-infrastructure communication.

16. The traffic light alert system of claim 14, wherein said traffic light alert system receives data encoded into light emitted by the traffic light.

17. The traffic light alert system of claim 16, wherein said control controls said display device responsive to processing of received encoded data.

18. A traffic light alert system for a vehicle, said traffic light alert system comprising:

a camera disposed at a vehicle equipped with said traffic light alert system, wherein said camera views at least forward of the equipped vehicle and captures image data;

wherein said camera is disposed at an in-cabin side of a windshield of the equipped vehicle and views through the windshield;

wherein said traffic light alert system determines presence of a traffic light ahead of the vehicle;

a processor that, responsive to determination of the traffic light ahead of the vehicle, processes image data captured by said camera to determine a signal status of the determined traffic light present ahead of the equipped vehicle and in the field of view of said camera;

a global positioning system of the equipped vehicle that is operable to determine a current geographical location of the equipped vehicle;

a display device of the equipped vehicle, wherein said display device is operable to display an iconistic traffic light representation;

a control of the equipped vehicle;

wherein, responsive to determination by said traffic light alert system of the traffic light ahead of the equipped vehicle and determination, via processing of image data captured by said camera, that the determined traffic light ahead of and being approached by the equipped vehicle has a particular signal status, said control controls said display device so that the displayed iconistic traffic light representation indicates the determined particular signal status;

wherein said control is operable to adjust orientation of the displayed iconistic traffic light representation between horizontal orientation and vertical orientation; and wherein said control adjusts orientation of the displayed iconistic traffic light representation between horizontal orientation and vertical orientation responsive to the current geographic location of the equipped vehicle as determined by the global positioning system of the equipped vehicle.

19. The traffic light alert system of claim 18, wherein the determination of the presence of the traffic light ahead of the equipped vehicle is made responsive to a communication system.

20. The traffic light alert system of claim 18, wherein the determination of the presence of the traffic light ahead of the equipped vehicle is made via visible light communication.

* * * * *